US008147193B2

(12) United States Patent
Weaver

(10) Patent No.: US 8,147,193 B2
(45) Date of Patent: Apr. 3, 2012

(54) DROPPED CEILING FAN HOUSING

(75) Inventor: William C. Weaver, Carmel, IN (US)

(73) Assignee: Thomas F. Noonan, Indianapolis, IN (US)

( * ) Notice: Subject to any disclaimer, the term of this patent is extended or adjusted under 35 U.S.C. 154(b) by 853 days.

(21) Appl. No.: 12/244,308

(22) Filed: Oct. 2, 2008

(65) Prior Publication Data

US 2009/0092488 A1 Apr. 9, 2009

Related U.S. Application Data

(63) Continuation-in-part of application No. 11/717,933, filed on Mar. 14, 2007, now Pat. No. 7,828,522.

(51) Int. Cl.
*F03B 11/02* (2006.01)

(52) U.S. Cl. ..... 415/213.1; 415/220

(58) Field of Classification Search ..... 415/213.1, 415/211, 220; 454/275, 277, 309
See application file for complete search history.

(56) References Cited

U.S. PATENT DOCUMENTS

| | | | | |
|---|---|---|---|---|
| 2,106,458 | A | 1/1938 | Kurth | 98/40 |
| 2,875,316 | A | 2/1959 | Ford et al. | 219/39 |
| 3,320,406 | A | 5/1967 | Wainwright | 219/370 |
| D287,888 | S | 1/1987 | Castor et al. | D26/59 |
| 4,662,912 | A | 5/1987 | Perkins | 55/316 |
| 4,730,551 | A | 3/1988 | Peludat | 98/315 |
| 5,078,574 | A | 1/1992 | Olsen | |
| 5,624,311 | A | 4/1997 | Peludat | 454/230 |
| D387,859 | S | 12/1997 | Ukai et al. | D23/371 |
| D457,232 | S | 5/2002 | Miura | D23/371 |
| 6,551,185 | B1 | 4/2003 | Miyake et al. | 454/234 |
| 6,974,381 | B1 | 12/2005 | Walker et al. | 454/230 |
| 7,467,931 | B2 | 12/2008 | O'Toole | |

*Primary Examiner* — Edward Look
*Assistant Examiner* — Dwayne J White
(74) *Attorney, Agent, or Firm* — Woodard, Emhardt, Moriarty, McNett & Henry LLP

(57) ABSTRACT

A modular ceiling fan housing unit designed to create a focused column or columns of downwardly moving air such that there is little deflection when the column or columns of downwardly moving air arrives at the ground level. The modular ceiling fan housing includes an elongated body element having a fluid impelling device to create the downwardly moving air. At least one plate disposed within the elongated body element directs the downwardly moving air into columns. The modular ceiling fan housing unit may be coupled to another modular ceiling fan housing unit to provide additional columns of downwardly moving air. The modular ceiling fan housing units may be coupled in various configurations, depending on the type of application. Furthermore, the modular ceiling fan housing unit or multiple modular fan housing units may be coupled to an elevated structure located either above or below the housing units.

20 Claims, 8 Drawing Sheets

DROPPED CEILING FAN HOUSING

CROSS-REFERENCE TO RELATED APPLICATIONS

This is a continuation-in-part of Ser. No. 11/717,933 filed Mar. 14, 2007 now U.S. Pat. No. 7,828,522.

BACKGROUND OF THE INVENTION

Fan housing units are used in various industries to distribute, circulate, or divert fluids, such as air, propelled by a fluid impelling device. One example where fan housings are used is in the heating and cooling industry. Fan housings typically direct or circulate the flow of hot or cold air into particular rooms or areas within a building or structure. Fan housings may be coupled to a duct or a fluid impelling device. The duct may carry the air from a heating or cooling unit to an opening of the fan housing. The shape and design of the fan housing unit may either disperse the air current over a wide area or redirect the air current to another duct or fan housing unit.

One purpose of current fan housing units is to circulate air to heat or cool an area quickly and efficiently. As a result, the shape and design of current fan housing units typically do not direct the air to a centralized or focused location. To direct the air to a localized area, instead of dispersing the air over a wide area, will result the room or area to have a substantial temperature gradient. Moreover, more air and energy would be required before the room temperature is substantially uniform. To overcome some temperature gradient situations, ceiling fans may be employed, generally without any housing unit, to further disperse and mix the air over a wide area within a room. The term "ceiling fan" is used in this document in the conventional sense to refer to a fan not connected with the ducting of any central HVAC system and adapted to be situated to move air substantially vertically within an area.

In a commercial setting, such as a department store or warehouse, the requirements may be different. For example, a commercial or industrial structure may have higher ceilings than a residential unit. Moreover, commercial settings may also include aisles or display units comprising products or goods with rows therebetween. In such a setting, dispersing the air over a wide area may not effectively circulate, heat, or cool the areas between the display units. Accordingly, one problem with conventional ceiling fans is that they do not direct the air to a focused location within a room, but rather tend to disperse the air over a wide area. Conventional ceiling fans are not designed to produce a sufficient column of air that will remain focused on a localized area as the air approaches the ground level.

Accordingly, there is a need to provide a ceiling fan with a housing unit that is capable of providing a column of air in localized areas. Additionally, there is further a need for a ceiling fan housing unit that, when coupled to a structure substantially above the ground level, is capable of providing a column of air that remains substantially localized as the column approaches the ground level. Additionally, there is further a need for a ceiling fan housing unit that is modular so that, when coupled to similar modular ceiling fan housing units, can deliver an enhanced column of air that remains substantially localized as the column approaches the ground level. Additionally, there is a need for a ceiling fan in a housing that can be supported on a conventional dropped ceiling to provide a column of air that remains substantially localized as the column approaches the ground level.

SUMMARY

In one embodiment, a housing unit for a ceiling fan for displacing fluid substantially along a single direction includes an elongated body element having a first end and a second end defining an aperture therethrough along a vertical axis. A flange is disposed within the elongated body element and is perpendicular to the vertical axis. A mounting bracket is disposed adjacent to the first end of the body element, and is operative to couple with a fluid impelling device. Also disposed within the elongated body element is at least one plate that is substantially perpendicular to the flange and creates a column of downwardly moving fluid below the second end of the elongated body element.

In another embodiment, a housing unit for a ceiling fan includes a fluid impelling device and an elongated body element having a first end and a second end defining an aperture therethrough along a vertical axis. A mounting bracket is disposed adjacent to the first end of the body element, where the mounting bracket is operatively coupled to the fluid impelling device. A flange is disposed within the elongated body element and is perpendicular to the vertical axis. The flange further defines an opening that permits the fluid impelling device to displace fluid towards the second end of the elongated body element. At least one plate is disposed within the elongated body element and is substantially perpendicular to the flange, which creates a column of downwardly moving fluid below the second end of the body element.

In another embodiment, a housing for a ceiling fan has an elongated body element having an upper end and a lower end defining an aperture therethrough along a vertical axis. A mounting bracket can be disposed adjacent to the upper end of the body element, and a fluid impelling device can be operatively coupled to the mounting bracket. At least one plate can be disposed within the elongated body element substantially parallel to the vertical axis to create a column of downwardly moving fluid below the lower end of the body element. A support can be coupled to the lower end of the body element that includes a central outlet opening aligned with the lower end of the body element, a peripheral intake opening surrounding the lower end of the elongated body element, and a peripheral supporting edge defining the outermost edge of the peripheral opening to contact a dropped-ceiling support grid. The central outlet opening of the support can include a grid work of vertically oriented elements to further direct the column of downwardly moving fluid below a lower surface of the support toward the ground level. The peripheral intake opening can include a plurality of inclined elements for directing air located adjacent to the dropped ceiling lower surface into an area surrounding the elongated body element leading to the elongated body element upper end. A peripheral housing can also be present having walls substantially aligned with the support peripheral support edge that extend upward from the support peripheral support edge to a point above the elongated body element upper end.

The various embodiments provide significant advantages over other modular ceiling fan housing units. For example, and without limitation, the ability of the modular ceiling fan housing unit to provide a column of air to localized areas at ground level is one significant advantage over other ceiling fan units. Furthermore, the modular ceiling fan housing unit is capable of providing this localized column of air when coupled to a structure substantially above ground level. The modular ceiling fan housing units are also capable of being coupled to similar ceiling fan housing units, and will provide an enhanced column of air that remains substantially localized as the column approaches the ground level.

The foregoing paragraphs have been provided by way of a general introduction, and are not intended to limit the scope of the following claims. The various embodiments, together with further advantages, will be best understood by reference to the following detailed description taken in conjunction with the accompanying drawings.

DETAILED DESCRIPTION OF PREFERRED EMBODIMENTS

The following detailed description and appended drawings describe and illustrate various exemplary embodiments of the invention. The description and drawings serve to enable one skilled in the art to make and use the invention, and are not intended to limit the scope of the invention in any manner.

The disclosed embodiments relate to a modular ceiling fan housing unit 10 that is capable of creating a column of air that is very focused in direction and is capable of maintaining a focused column of air to the ground level, even if the modular ceiling fan housing unit 10 is coupled to a structure substantially above the ground level. As used herein, the term "coupled" means directly connected to or indirectly connected through one or more intermediate components, including but not limited to the structure of the modular ceiling fan housing unit 10.

Figure 1:
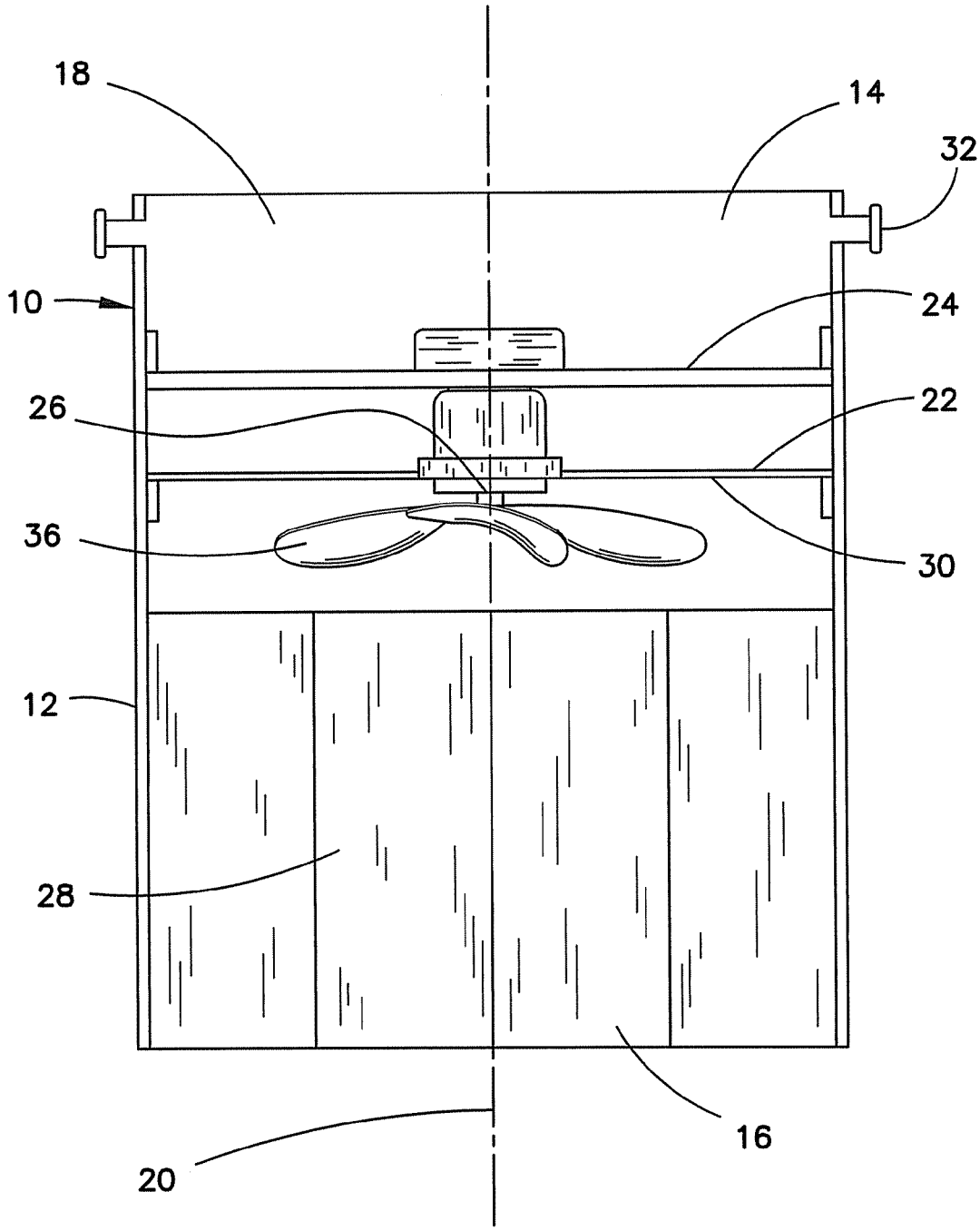
FIG. 1 is a sectional view of a modular ceiling fan housing unit.
Figure 2:
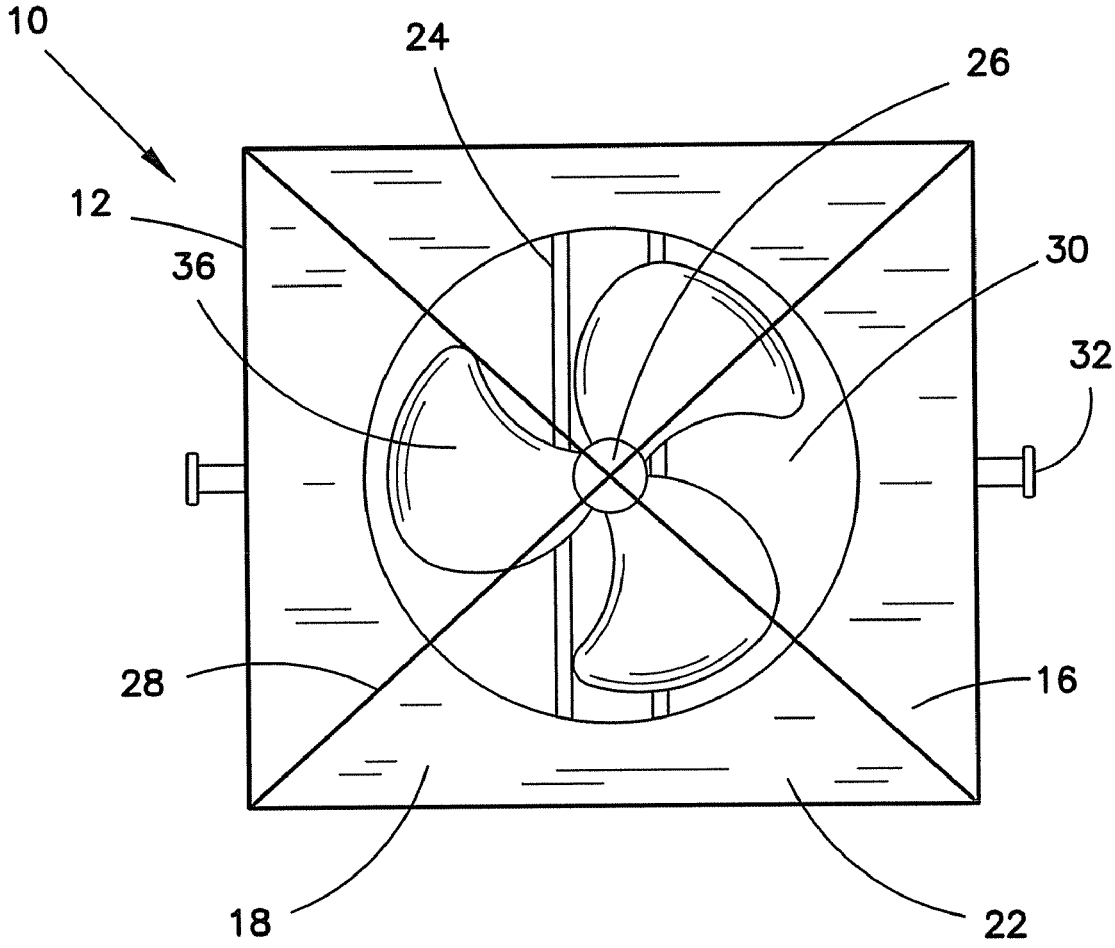
FIG. 2 is a bottom plan view of the modular ceiling fan housing unit of FIG. 1.
Figure 3:
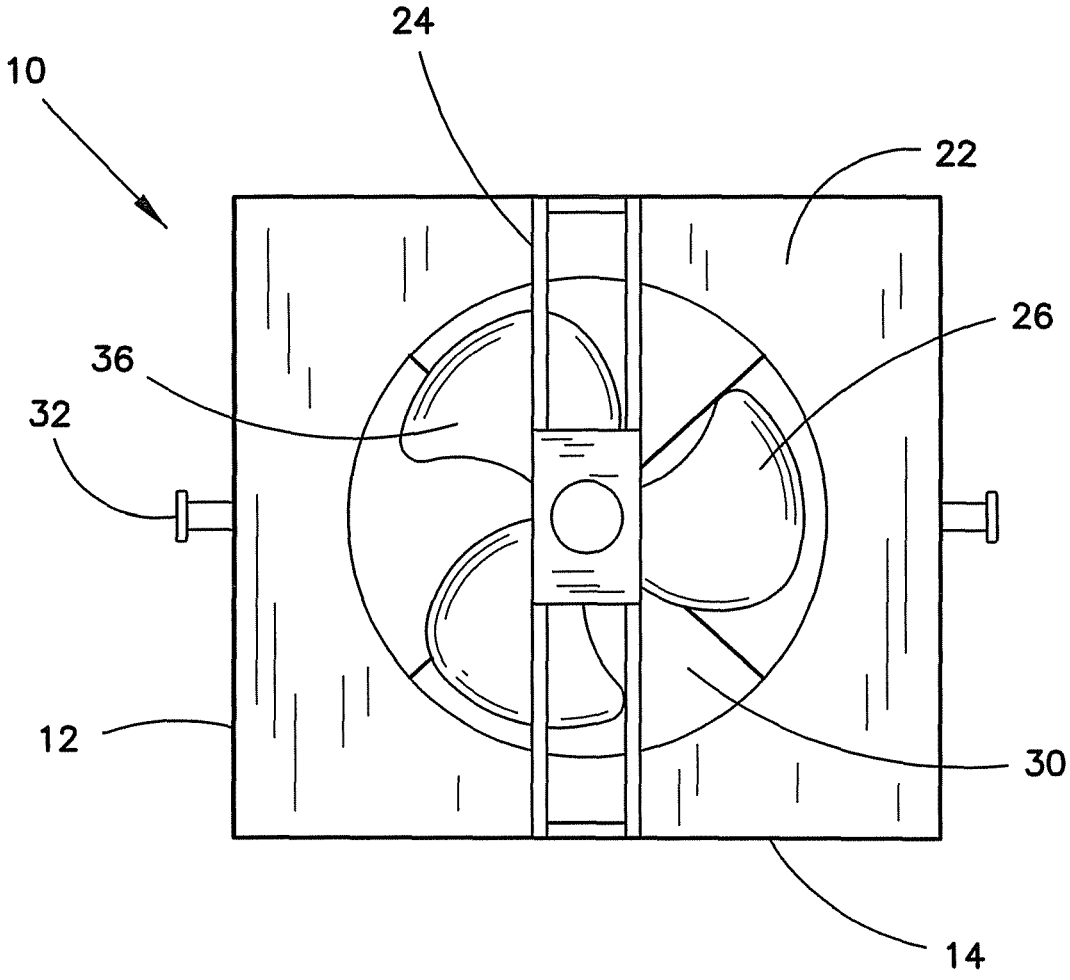
FIG. 3 is a top plan view of the modular ceiling fan housing unit of FIG. 1.

Turning now to the drawings, FIGS. 1, 2, and 3 illustrate a modular ceiling fan housing unit 10, according to a first embodiment, comprising an elongated body element 12 having a first end 14 and a second end 16 defining an aperture 18 therethrough. The housing unit 10 is defined by a vertical axis 20 that extends from the first end 14 through the second end 16 of the elongated body element 12. It can be appreciated that the elongated body element 12 may have a circular shape, oblong shape, rectangular shape, pyramidal shape, or a combination thereof. Disposed between the first 14 and second 16 ends of the elongated body element 12 is a fluid impelling device 26. The fluid impelling device 26 may consist of one or more blades 36 and may be motorized or manually actuated. Alternatively, the fluid impelling device 26 may consist of a jet-like turbine having blades 36 internally disposed within the housing of the fluid impelling device 26. Coupled to the fluid impelling device 26 is a mounting bracket 24. As shown in FIGS. 1 and 3, the mounting bracket 24 is coupled with the elongated body element 12 and is disposed between the fluid impelling device 26 and the first end 14 of the elongated body element 12. Alternatively, the mounting bracket 24 may be located below the fluid impelling device 26.

Disposed between the first 14 and second 16 ends of the elongated body element 12 is a flange 22 having an opening 30 that is designed to allow the column of air produced by the fluid impelling device 26 to pass therethrough. The flange 22 is substantially perpendicular to the vertical axis 20 and, as shown in FIG. 2, the opening 30 of the flange 22 is circular in shape. However, it can be appreciated that the opening 30 may take the form of other shapes, such as, but not limited to, elliptical, oval, or rectangular. The opening 30 of the flange 22 may be sufficient to allow the blades 36 of the fluid impelling device 26 to at least partially pass therethrough, as shown in FIG. 1. However, the flange 22 may be adjustable with respect to the elongated body element 12 and therefore the flange 22 may be moved relative to the fluid impelling device 26. To allow the flange 22 to be adjusted with respect to the fluid impelling device 26, the flange may be slidably engaged to a slot (not shown) or a series of slots (not shown) along the elongated body element 12.

Disposed between the flange 22 and the second end 16 of the elongated body element 12 is at least one plate 28. The plate 28 is substantially perpendicular to the flange 22. In one preferred embodiment, as shown in FIG. 1, the modular ceiling fan housing unit 10 has two plates 28 that intersect each other along the vertical axis 20. The plates 28 may be completely disposed within the elongated body element 12 and may be coupled to the elongated body element 12 along its corners, as shown in FIG. 2, or anywhere therebetween. It can be appreciated that more than two plates 28 may be disposed within the elongated body element 12. Moreover, the plates 28 need not intersect each other along the vertical axis 20. The plates 28 may, for example, intersect each other at an axis parallel to the vertical axis 20, or not intersect at all. Furthermore, the plates 28 may be of different lengths, widths, and thicknesses and may not extend to the second end 16 of the elongated body element 12.

Figure 4:
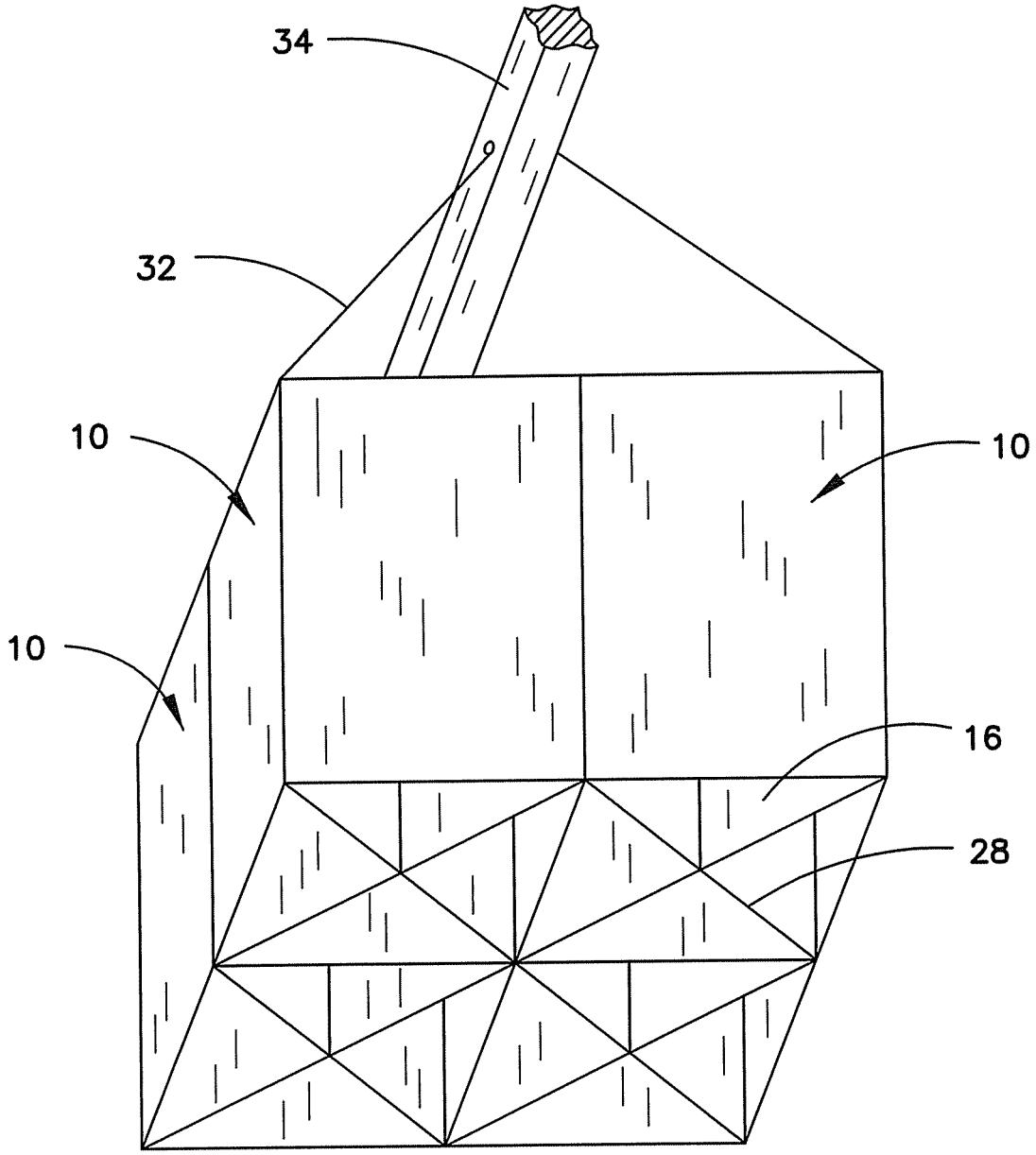
FIG. 4 is a perspective view of multiple ceiling fan housing units as shown in FIGS. 1-3 coupled together in one assembly.
Figure 5:
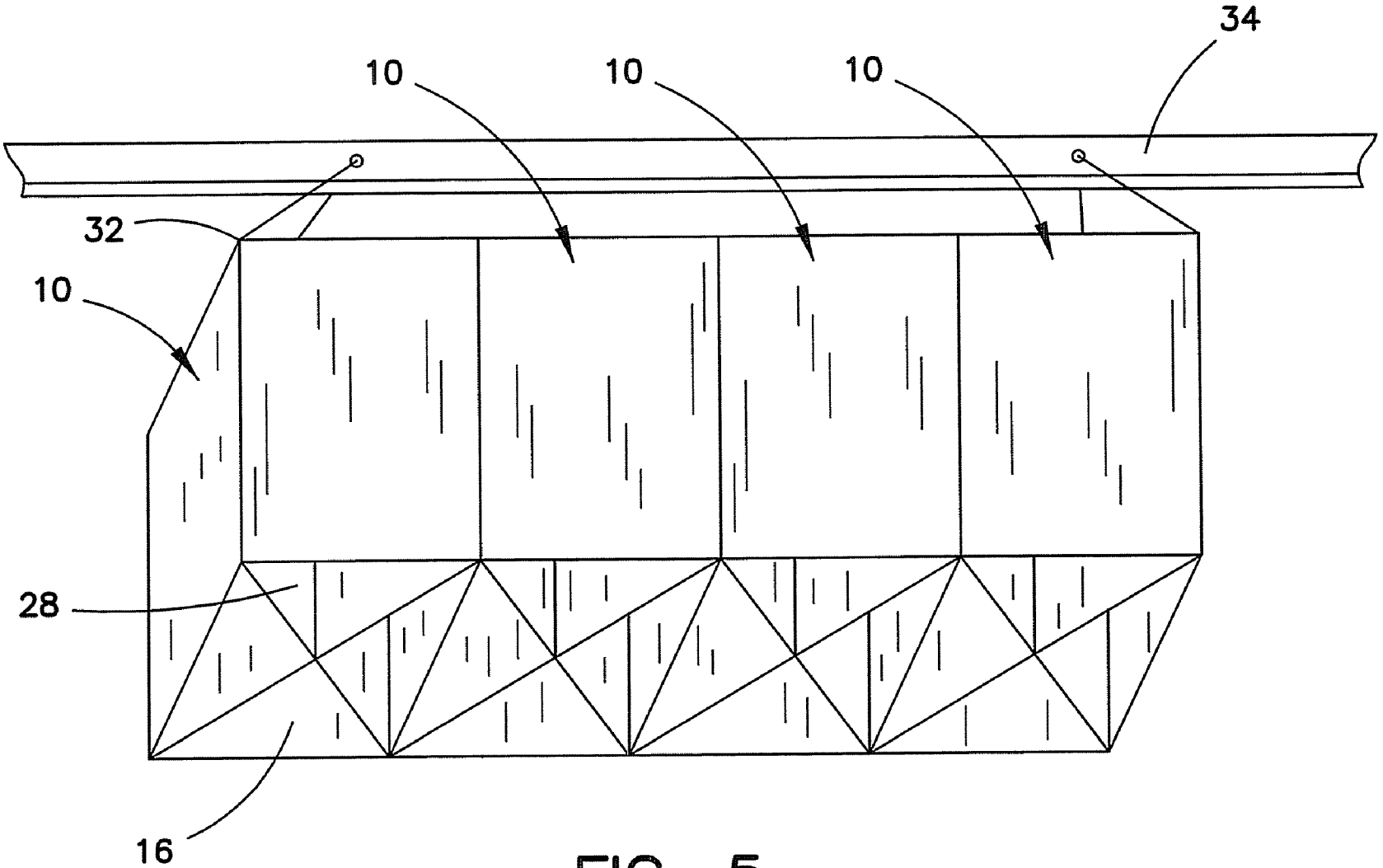
FIG. 5 is a perspective view of multiple ceiling fan housing units as shown in FIGS. 1-3 coupled together in another assembly.

As illustrated in FIGS. 1, 2, and 3, coupled to the first end 14 of the elongated body element 12 is a fastener 32. The fastener 32 is designed to couple the elongated body element 12 to an elevated structure 34, such as a ceiling truss or I-beam, as shown in FIGS. 4 and 5. More than one fastener 32 may be coupled to either side of the housing unit 10, depending on the size and weight of the housing unit 10 and configuration of the elevated structure 34. The fastener 32 may be comprised of an eye-hook, latch mechanism, snap locks, brackets, nut and bolt configuration, or a combination thereof. Alternatively, it can be appreciated that the elongated body element 12 may be coupled to the elevated structure 34 by simply looping a chain or a cord through an aperture (not shown) on each side of the first end 14 of the elongated body element 12.

As shown in FIG. 4, the housing units 10 are modular so that more than one housing unit 10 may be coupled together on multiple sides. The fasteners 32 used to couple the housing units 10 may comprise of an eye-hook, latch mechanism, snap locks, brackets, nut and bolt configuration, or a combination thereof. An alternative configuration is shown in FIG. 5, where the housing units 10 are coupled in a stacked configuration. It can be appreciated that the housing units 10 may be coupled together in a variety of configurations and may be application dependent.

In operation, the fluid impelling device 26 of the housing unit 10 creates a column of air moving towards the second end 16 of the elongated body element 12. The column of air is confined to the dimensions of the aperture 18 defined by the elongated body element 12 and is prevented from traveling towards the first end 14 of the elongated body element 12 by the flange 22. The column of air is directed between the plates 28 that are disposed within the elongated body element 12, thereby creating a more focused column of air with a width substantially equal to the opening of the second end 16 of the elongated body element 12. Once the column or columns of air move beyond the second end 16 of the elongated body element 12, the focused column or columns of air travel towards the ground level of the structure without major deflection. For example, if the housing unit 10 is coupled to an elevated structure 34 in a 25 to 40 foot ceiling arrangement, the column of air will only spread approximately two to four times the width of the second end 16 of the elongated body element 12 once the column of air reaches the ground level. As previously discussed, the housing units 10 may be coupled together to create a larger column of moving air without major deflection at the ground level. Alternatively, the column or columns of air produced by the housing units 10 may also be directed to areas other than the ground level.

Figure 6:
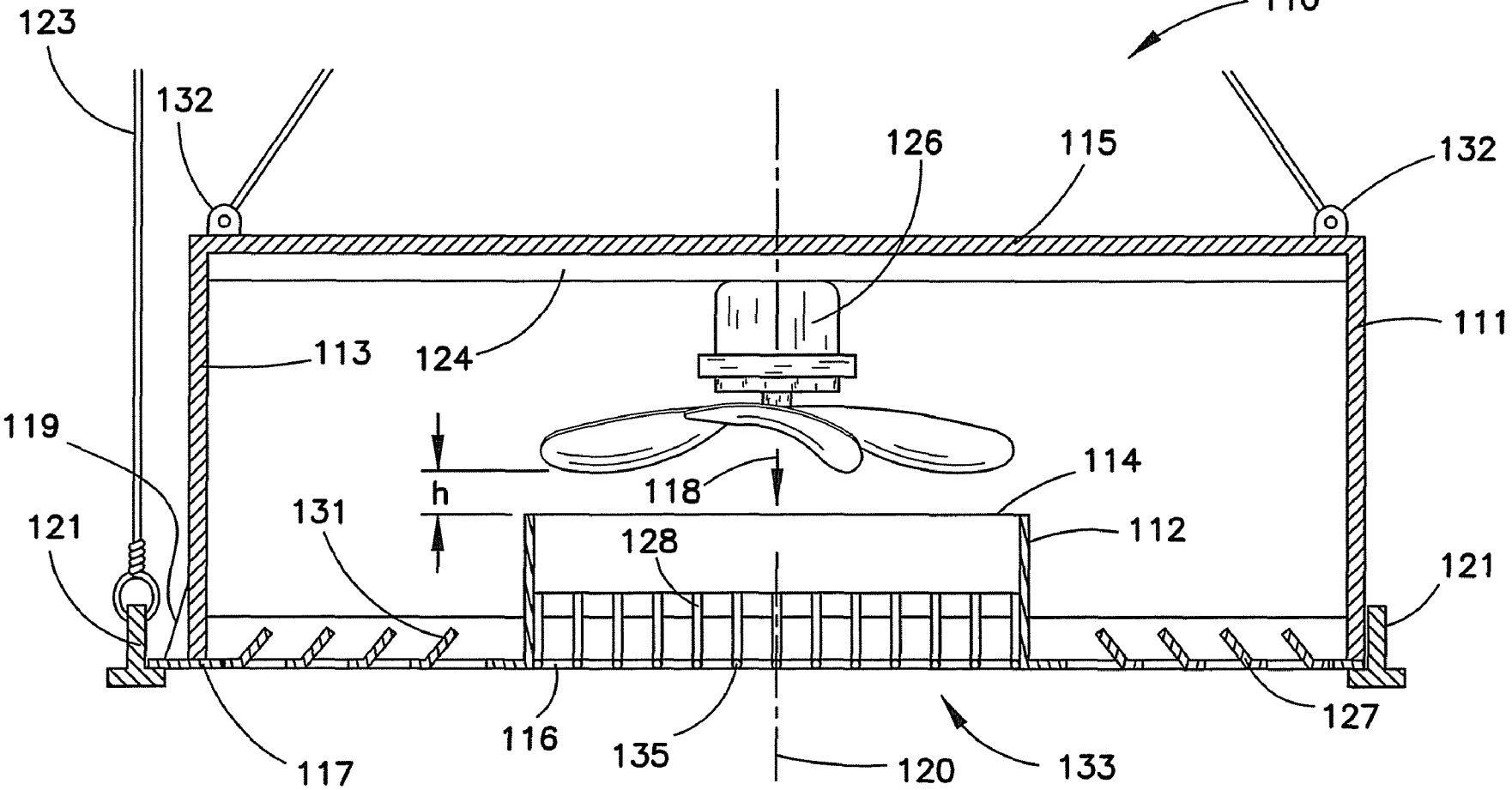
FIG. 6 is a sectional view similar to FIG. 1 of another modular ceiling fan housing unit.
Figure 7:
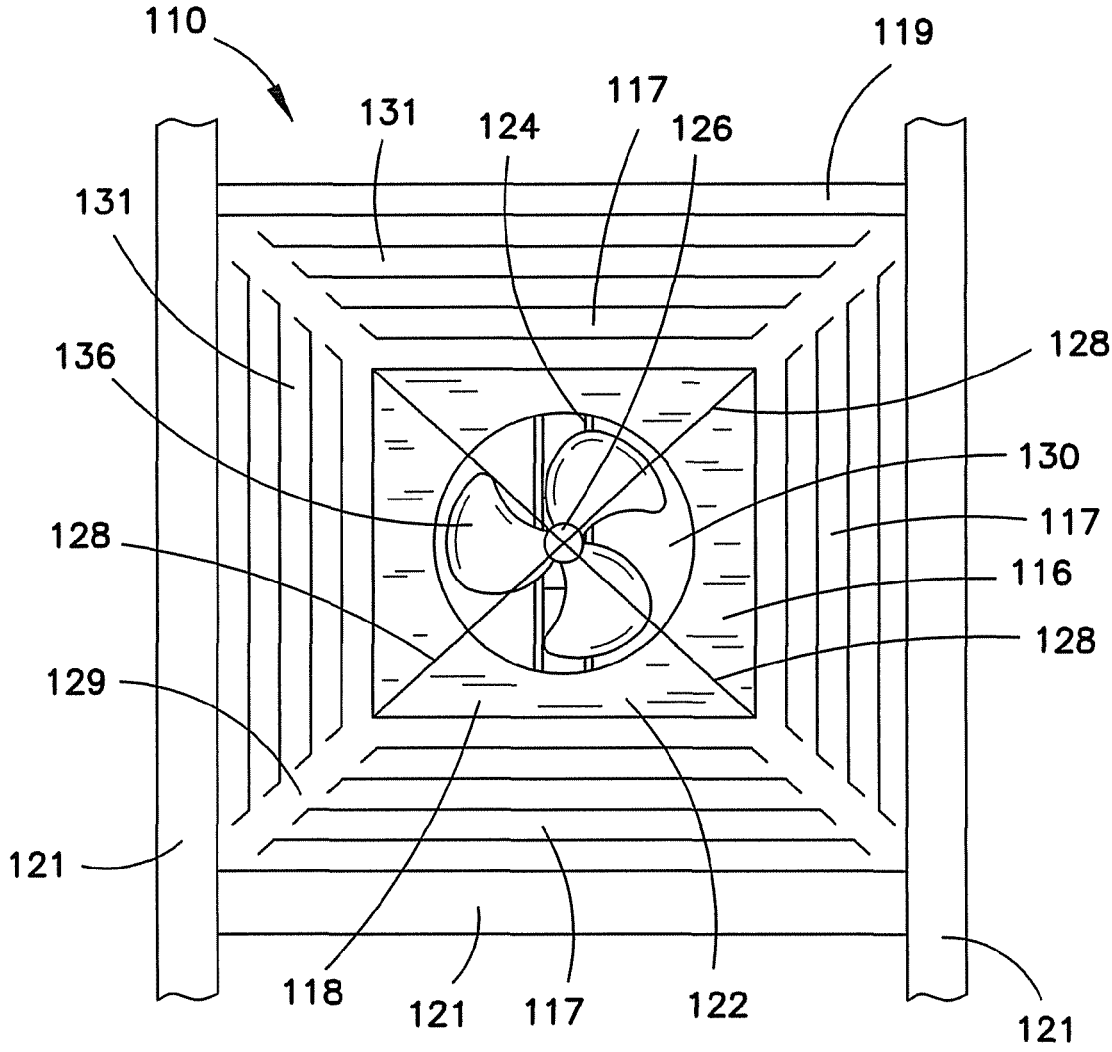
FIG. 7 is a bottom plan view similar to FIG. 2 of the ceiling fan housing unit shown in FIG. 6.
Figure 8:
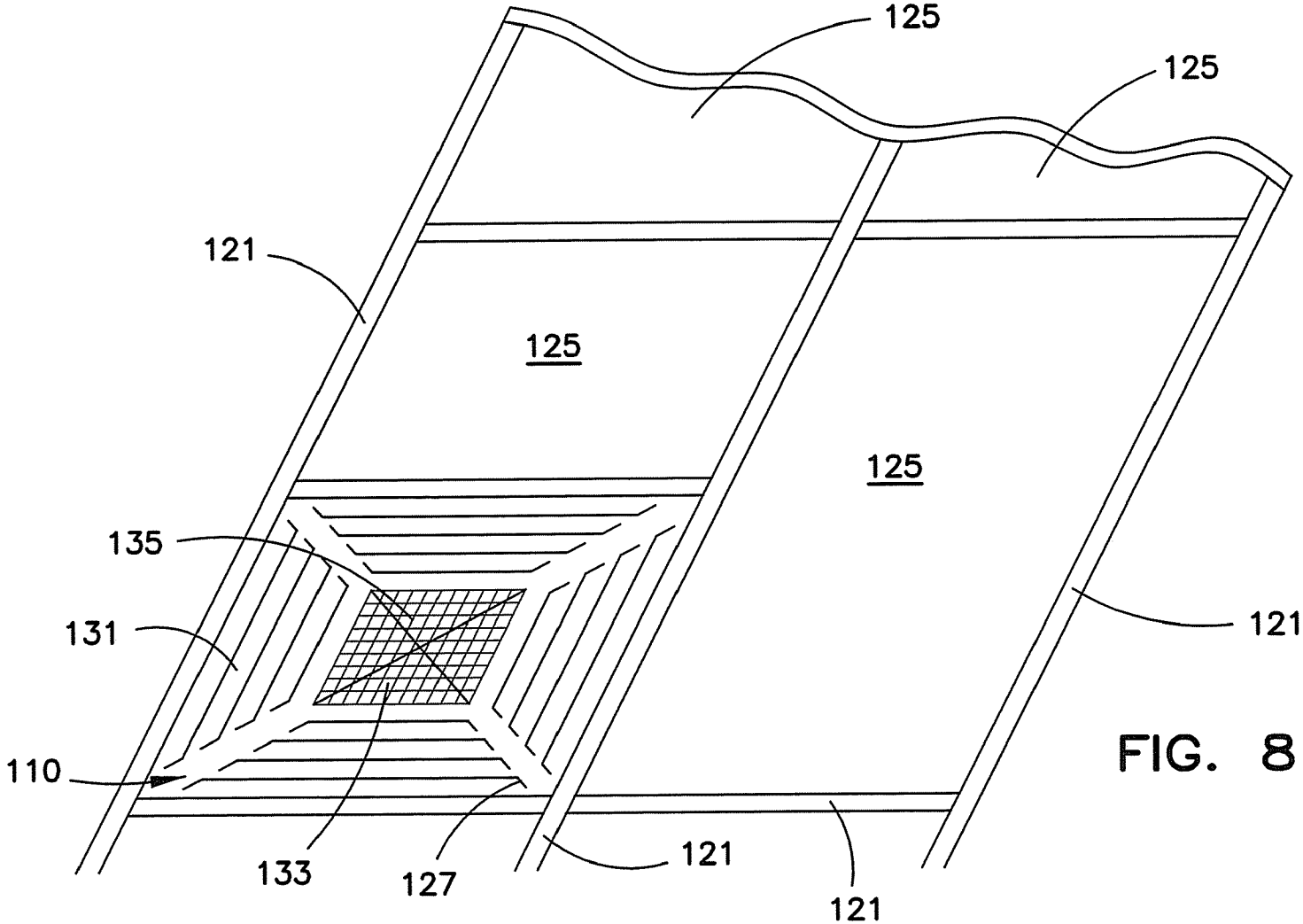
FIG. 8 is a perspective view of the ceiling fan housing unit shown in FIG. 6.

FIGS. 6, 7, and 8 illustrate a modular ceiling fan housing unit 110, according to a second embodiment, comprising a body element 112 having a first end 114 and a second end 116 defining an aperture 118 therethrough. The housing unit 110 is defined by a vertical axis 120 that extends from the first end 114 through the second end 116 of the elongated body element 112. The elongated body element 112 may have a circular shape, oblong shape, rectangular shape, pyramidal shape, or a combination thereof. A shroud 111, including side walls 113 and top wall 115, surrounds the elongated body element 112. The top wall 115 of the shroud 111 is spaced above the first end 114 of the elongated body element 112. A fluid impelling device 126 is disposed above the first end 114 of the elongated body element 112 in close proximity thereto. The distance h between the fluid impelling device 126 and the first end 114 of the elongated body element 112 can be about 1.5 inches (3.8 cm.). The opening 118 is designed to allow the column of air produced by the fluid impelling device 126 to pass from the interior of the shroud 111 downward through the elongated body element 112. The opening 118 may be of sufficient size to allow the blades 136 of the fluid impelling device 126 to at least partially pass therethrough, as shown in FIG. 6. The fluid impelling device 126 can consist of one or more blades 136 and is preferably motorized. As in the first embodiment, the fluid impelling device 126 may consist of a jet-like turbine having blades 136 internally disposed within the housing of the fluid impelling device 126. A mounting bracket 124 is coupled to the fluid impelling device 126. As shown in FIG. 6, the mounting bracket 124 is coupled with the side walls 113 of shroud 111. The mounting bracket 124 couples the fluid impelling device 126 above the first end 114 of the elongated body element 112. Alternatively, the mounting bracket 124 may be located below the fluid impelling device 126.

At least one plate 128 can be disposed between the first end 114 and the second end 116 of the elongated body element 112. The at least one plate 128 can be oriented substantially parallel to the axis 120. In one preferred embodiment, as shown in FIG. 7, the modular ceiling fan housing unit 110 has two plates 128 that intersect each other along the vertical axis 120. The plates 128 may be completely disposed within the elongated body element 112 and may be coupled to the elongated body element 112 along its corners, or anywhere therebetween. It can be appreciated that more than two plates 128 may be disposed within the elongated body element 112. Moreover, the plates 128 need not intersect each other along the vertical axis 120. The plates 128 may, for example, intersect each other along a line that is parallel to the vertical axis 120, or the plates 128 may not intersect at all. Furthermore, the plates 128 may be of different lengths, widths, and thicknesses and may not extend to the second end 116 of the elongated body element 112. The plates 128 can form a rectangular array as shown in FIGS. 6 and 8.

The shroud 111 includes a lower edge 117 that can include an outwardly extending flange 119. The outwardly extending flange 119 can be dimensioned to be received on the supports 121 of a dropped ceiling support grid, the supports being suspended in the conventional manner from substantially vertical wires 123. The supports 121 conventionally define a rectangular grid adapted to receive ceiling panels 125, shown in FIGS. 7 and 8. The ceiling panels 125 conventionally have a length-to-width ratio of 2:1, but can be of various dimensions and length-to-width ratios. The ceiling fan housing unit 110 is preferably square so as to fit the space that would be occupied by one half of a ceiling panel 125, but could have other various dimensions and length-to-width ratios. The ceiling fan housing units 110 are modular so that more than one housing unit 110 may be coupled together on multiple sides, or simply positioned adjacent to each other on the ceiling supports 121 in a variety of patterns.

Additional support can be provided by one or more fasteners 132 coupling the shroud 111 to an elevated structure 34, such as a ceiling truss or I-beam, as shown in FIGS. 4 and 5. The elevated structure 34 can be coupled to fasteners 132 by means of a wire, a chain or a cord depending on the size and weight of the unit 110 and configuration of the elevated structure 34. The Fasteners 132 may be located on any side 113 of the shroud 111 or to the top wall 115 of the shroud 111 as shown in FIG. 6. The fastener 132 may be comprised of an eye-hook, latch mechanism, snap locks, brackets, nut and bolt configuration, or a combination thereof.

The ceiling fan housing unit 110 also can include a face plate 127, shown in FIGS. 6-8 that covers at least a perimeter portion 129 surrounding the second end 116 of the elongated body element 112. The face plate 127 preferably includes a plurality of baffles 131. The baffles 131 are show to be inwardly directed from the face plate 127, but could also extend downwardly and outwardly from the face plate 127. The face plate 127 can include a further pattern of openings 133 defined by a grid work of vertically oriented elements 135 over the second end 116 of the elongated body element 112 as shown in FIG. 8.

In operation, the baffles 131 direct air that approaches the ceiling fan housing unit 110 from the region immediately below the adjacent ceiling panels 125 into the region between the shroud 111 and the elongated body element 112. Air entering the region between the shroud 111 and the elongated body element 112 flows upwardly and into the space between the top wall 115 of the shroud 111 and the first end 114 of the elongated body element 112. The fluid impelling device 126 of the ceiling fan housing unit 110 creates a downward moving column of air moving towards the second end 116 of the elongated body element 112. The column of air is confined to the dimensions of the aperture 118 defined by the elongated body element 112 and is inhibited from traveling back towards the first end 114 of the elongated body element 112. The column of air is directed between the plates 128 that are disposed within the elongated body element 112, thereby creating a more focused column of air with a width substantially equal to the opening of the second end 116 of the elongated body element 112. The column of air can be further directed by a grid work of elements 135 to further direct the column of downwardly moving fluid below a lower surface of the support.

Once the column of air moves beyond the second end 116 of the elongated body element 112, the focused column of air travel towards the ground level of the structure without major deflection. For example, if the housing unit 110 is installed in a dropped ceiling in a grocery store over an aisle between refrigerated displays, a column of air having a temperature of the air immediately below the ceiling can be delivered to floor level of the aisle to increase the comfort level of shoppers with only a minimum expenditure of energy. The column of air will generally only spread approximately two to four times the width of the second end 116 of the elongated body element 112 as the column of air reaches the floor level. As previously discussed, the ceiling fan housing units 110 may be coupled together to create a larger column of moving air without major deflection at the ground level. It is particularly desirable to locate a plurality of the ceiling fan housing units 110 in a row above an aisle and to adjust the speed of the fluid impelling device 126 to achieve the desired comfort level for shoppers.

While the invention has been illustrated and described in detail in the drawings and foregoing description, the same is to be considered as illustrative and not restrictive in character, it being understood that only exemplary embodiments have been shown and described and do not limit the scope of the invention in any manner. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

The invention claimed is:

1. A ceiling fan comprising:

an elongated body element having an upper end and a lower end defining an aperture therethrough along a vertical axis;

a mounting bracket disposed adjacent to the upper end of the body element, and a fluid impelling device operatively coupled to the mounting bracket;

at least one plate disposed within the elongated body element and substantially parallel to the vertical axis to create a column of downwardly moving fluid below the lower end of the body element, a support coupled to the lower end of the body element including a central outlet opening aligned with the lower end of the body element, a peripheral intake opening surrounding the lower end of the elongated body element and a peripheral supporting edge defining the outermost edge of the peripheral opening to contact a dropped-ceiling support grid, and a plurality of inclined elements in the peripheral intake opening constructed and arranged to direct air located adjacent to the dropped ceiling lower surface into an area surrounding the elongated body element leading to the elongated body element upper end.

2. The ceiling fan of claim 1, wherein at least one plate disposed within the elongated body element further comprises at least two plates that intersect each other.

3. The ceiling fan of claim 1, wherein the central outlet opening of the support includes a grid work of vertically oriented elements to further direct the column downwardly moving fluid below a lower surface of the support.

4. The ceiling fan of claim 1, wherein the fluid impelling device is spaced about 1.5 inches apart from the upper end of the elongated body element.

5. The ceiling fan of claim 1, further comprising a grid work of vertically oriented elements below the second end of the elongated body element defining a pattern of outlet openings.

6. The ceiling fan of claim 1, further comprising a peripheral housing having walls substantially aligned with the peripheral supporting edge and extending upward from the support peripheral support edge to a point above the elongated body element upper end.

7. The ceiling fan of claim 6, further comprising a housing top wall joining the peripheral housing walls together, the housing top wall being spaced above the elongated body element upper end.

8. The ceiling fan of claim 7, wherein the joined peripheral housing walls and the housing top walls define an interior volume and wherein the aperture through the elongated body element is constructed and arranged to direct a column of air produced by the fluid impelling device to pass from the interior volume downward through the elongated body element.

9. The ceiling fan of claim 8, wherein the plurality of inclined elements are constructed and arranged to direct air located adjacent to the dropped ceiling lower surface into the interior volume.

10. The ceiling fan of claim 8, wherein the fluid impelling device is spaced apart from the upper end of the elongated body element.

11. The ceiling fan of claim 1, wherein the fluid impelling device is supported by the mounting bracket in general alignment with the vertical axis of the elongated body.

12. A ceiling fan comprising:

an elongated body element having an upper end and a lower end defining an aperture therethrough along a vertical axis;

a shroud having peripheral walls extending upward from a lower end parallel to the elongated body element lower end to a height above the elongated body element upper end and a top wall joining the peripheral walls together, the shroud top wall being spaced above the elongated body element upper end;

a mounting bracket coupled to at least two of the shroud peripheral walls and disposed adjacent to the upper end of the elongated body element, and a fluid impelling device operatively coupled to the mounting bracket;

a support edge coupled to the shroud peripheral walls lower end to contact a dropped-ceiling support grid, the support edge being spaced laterally outward from the elongated body element lower end to define a peripheral intake opening surrounding the lower end of the elongated body element; and a baffle coupled to the support edge including a plurality of inclined elements directing air located adjacent to the dropped ceiling lower surface into an area surrounding the elongated body element leading to the elongated body element upper end, the baffle including a central outlet opening aligned with the lower end of the elongated body element.

13. The ceiling fan of claim 12, further comprising a grid work of vertically oriented elements below the second end of the elongated body element defining a pattern of outlet openings.

14. The ceiling fan of claim 12, further comprising at least one plate disposed within the elongated body element having a surface parallel to the vertical axis.

15. The ceiling fan of claim 14, wherein the at least one plate comprises a pair of plates intersecting along the vertical axis.

16. The ceiling fan of claim 15, further comprising a flange joined to an interior surface of the elongated body element perpendicular to the axis, the flange including an inner edge surrounding the fluid impelling device that defines an opening through the flange.

17. The ceiling fan of claim 12, wherein the shroud defines an interior volume and wherein the aperture through the elongated body element is constructed and arranged to direct a column of air produced by the fluid impelling device to pass from the interior volume downward through the elongated body element.

18. The ceiling fan of claim 17, wherein the fluid impelling device is spaced apart from the upper end of the elongated body element.

19. A method of directing a flow of air from a region immediately below a dropped ceiling having a lower surface defined by an array of ceiling tile supports toward a region adjacent to a floor below the dropped ceiling comprising:

supporting a shroud upon at least a pair of the ceiling tile supports, the shroud including a plurality of peripheral walls and a top wall joining the peripheral walls together;

coupling an elongated body element within the shroud, the elongated body element having an upper end spaced from the shroud top wall and a lower end, the elongated body element defining an aperture therethrough along a vertical axis;

coupling a mounting bracket to at least two of the shroud peripheral walls, the mounting bracket supporting a fluid impelling device in general alignment with the vertical axis;

providing a face plate below the shroud lower end, the face plate including a plurality of inclined baffles situated below a region between the shroud lower end and the elongated body element lower end, the face plate including a central outlet opening aligned with the lower end of the elongated body element; and supplying power to the fluid impelling device to cause air located adjacent to the dropped ceiling lower surface through the baffles into the region surrounding the elongated body element leading to the elongated body element upper end, the fluid impelling device creating a downward moving column of air moving downward from the second end of the elongated body element.

20. The method of claim 19, wherein the mounting bracket supports the fluid impelling device spaced apart from the upper end of the elongated body element.

* * * * *